US009105381B2

(12) United States Patent
Girard et al.

(10) Patent No.: US 9,105,381 B2
(45) Date of Patent: Aug. 11, 2015

(54) HIGH FREQUENCY INDUCTOR STRUCTURE HAVING INCREASED INDUCTANCE DENSITY AND QUALITY FACTOR

(71) Applicant: International Business Machines Corporation, Armonk, NY (US)

(72) Inventors: Philippe P. D. Girard, Le Coudray-Montceaux (FR); Robert A. Groves, Highland, NY (US); Srikumar Konduru, Bangalore (IN); Venkata N. R. Vanukuru, Bangalore (IN)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 13/718,701

(22) Filed: Dec. 18, 2012

(65) Prior Publication Data

US 2013/0106554 A1 May 2, 2013

Related U.S. Application Data

(63) Continuation-in-part of application No. 13/012,027, filed on Jan. 24, 2011, now Pat. No. 8,754,736.

(51) Int. Cl.

| | |
|---|---|
| ***H01F 5/00*** | (2006.01) |
| ***H01F 27/28*** | (2006.01) |
| ***H01F 27/24*** | (2006.01) |
| ***H01F 17/00*** | (2006.01) |

(52) U.S. Cl.

CPC ..... *H01F 5/003* (2013.01); *H01F 17/0013* (2013.01); *H01F 2017/0073* (2013.01); *H01F 2017/0086* (2013.01)

(58) Field of Classification Search

CPC ..... H01F 17/0013
USPC ..... 336/200, 223, 232
See application file for complete search history.

(56) References Cited

U.S. PATENT DOCUMENTS

| | | | | |
|---|---|---|---|---|
| 7,053,460 | B2 | 5/2006 | Volant et al. | |
| 7,129,561 | B2 | 10/2006 | Coolbaugh et al. | |
| 7,598,836 | B2 * | 10/2009 | Lee | 336/147 |
| 8,441,333 | B2 | 5/2013 | Chiu et al. | |
| 2003/0116850 | A1 * | 6/2003 | Volant et al. | 257/758 |
| 2011/0109415 | A1 * | 5/2011 | Duh et al. | 336/200 |

OTHER PUBLICATIONS

Alireza Zolfaghari et al., "Stacked Inductors and Transformers in CMOS Technology", IEEE Journal of Solid-State Circuits, vol. 36, No. 4, Apr. 2001, all pages.

(Continued)

*Primary Examiner* — Elvin G Enad
*Assistant Examiner* — Ronald Hinson
(74) *Attorney, Agent, or Firm* — Law Offices of Ira D. Blecker, P.C.

(57) ABSTRACT

Disclosed is an inductor structure. The inductor structure includes a base material, a plurality of bottom spiral conductors disposed on the base material, and at least one top spiral conductor disposed on the at least one bottom spiral conductor, and dielectric material separating the bottom, middle and top spiral conductors. A current path for high frequency operation is disclosed. Also disclosed is a method for determining the number of turns in the at least one top spiral conductor and the at least one bottom spiral conductor.

5 Claims, 13 Drawing Sheets

(56) References Cited

OTHER PUBLICATIONS

M. Soyuer et al., "Multilevel monolithic inductors in silicon technology", Electronics Letters, vol. 31, No. 5, Mar. 2, 1995. all pages.
Silvaco, Interconnect Examples,[Retrieved on Dec. 17, 2012], Retrieved from the Internet < URL: http://www.silvaco.com.cn/examples/quest/section1/example15/index.html>.
Yoann Courant et al., "A Unified Analog Design and Process Framework for Efficient Modeling and Synthesis" [Retrieved on Dec. 17, 2012], Retrieved from the Internet < URL: -http://www.design-reuse.com/articles/16609/a-unified-analog-design-and-process-framework-for-efficient-modeling-and-synthesis.html>, pp. 2-3 (section entitled "Application: St Microelectronics Parameterized Inductor").
John R. Koza et al., Chapter 14 "Automated Synthesis by Means of Genetic Programming of Complex Structures Incorporating Reuse, Parameterized Reuse, Hierarchies, and Development", Genetic Programming Theory and Practice, [Retrieved on Dec. 17, 2012], Retrieved from the Internet < URL: <http://www.google.com/url?sa=t&rct=j&q=%22parameterized%20inductor%22&source=web&cd=8&ved=0CEsQFjAH&url=http%3A%2F%2Fciteseerx.ist.psu.edu%2Fviewdoc%2Fdownload%3Fdoi%3D10.1.1.140.9924%26rep%3Drep1%26type%.
Agilent EEsof EDA, Momentum Appendix, [Retrieved on Dec. 17, 2012], Retrieved from the Internet <URL:—http://cp.literature.agilent.com/litweb/pdf/5989-9605EN.pdf>, pages No. 8 ("GCC Example") and 52 ("Advanced Model Composer").
Prosecution History of related U.S. Appl. No. 13/012,027, Office Action dated Nov. 12, 2013, all pages.
Prosecution History of related U.S. Appl. No. 13/012,027, Amendment to Office Action dated Nov. 12, 2013, Amendment submitted Jan. 9, 2014, all pages.
Prosecution History of related U.S. Appl. No. 13/012,027, Notice of Allowance mailed Feb. 3, 2014, all pages.

* cited by examiner

HIGH FREQUENCY INDUCTOR STRUCTURE HAVING INCREASED INDUCTANCE DENSITY AND QUALITY FACTOR

RELATED APPLICATION

This application is a continuation in part of U.S. patent application Ser. No. 13/012,027, entitled "Inductor Structure Having Increased Inductance Density and Quality Factor", filed Jan. 24, 2011, the disclosure of which is incorporated by reference herein.

BACKGROUND

The present invention relates to the field of inductors, and particularly, to series parallel inductors having a high quality factor and a high inductance density built on a base material such as a semiconductor material.

In the semiconductor industry, digital and analog circuits, including complex microprocessors have been successfully implemented in semiconductor integrated circuits. Such integrated circuits may typically include active devices such as, for example, field effect transistors, and passive devices such as, for example, resistors, capacitors and inductors.

It is desirable to have an inductor with a high quality factor Q and a high inductance density. However, it is difficult to obtain a high quality factor Q while also maintaining a high inductance density. In conventional designs, the quality factor Q or inductance density usually is less than desirable.

BRIEF SUMMARY

The various advantages and purposes of the exemplary embodiments as described above and hereafter are achieved by providing, according to a first aspect of the exemplary embodiments, an inductor structure. The inductor structure including: a base material; a plurality of bottom spiral conductors having a first number of turns n2 of the spiral disposed on the base material, the plurality of bottom spiral conductor having thicknesses $t_{bot1}, t_{bot2}, \ldots t_{botn}$ measured in a vertical direction from the base material; at least one top spiral conductor having a second number of turns n1 of the spiral in contact with the plurality of bottom spiral conductors, the at least one top spiral conductor having a thickness $t_{top1}$ measured in a vertical direction from the base material, a width $W_{thick}$ and a turn to turn spacing $S_{thick}$ wherein the width $W_{thick}$ and turn to turn spacing $S_{thick}$ being measured in a direction parallel to the base material, such that $t_{top1}$ is greater than $t_{bot1}, t_{bot2}, \ldots t_{botn}$; and dielectric material separating the bottom and top spiral conductors; each turn of the at least one top spiral conductor being in axial alignment with a turn of the plurality of bottom spiral conductors, the inductor structure having a current path from a turn of the at least one top spiral conductor to an axially aligned turn of the plurality of bottom spiral conductors to a next turn of the plurality of bottom spiral conductors to an axially aligned turn of the at least one top spiral conductor to a next turn of the top spiral conductor and continuing until the current path has passed through all turns of the at least one top spiral conductor and the plurality of bottom conductors.

According to a second aspect of the exemplary embodiments, there is provided an inductor structure which includes a base material; a plurality of bottom spiral conductors having a first number of turns n2 of the spiral disposed on the base material, the plurality of bottom spiral conductors having thicknesses $t_{bot1}, t_{bot2}, \ldots t_{botn}$ measured in a vertical direction from the base material; at least one top spiral conductor having a second number of turns n1 of the spiral in contact with the plurality of bottom spiral conductors, the at least one top spiral conductor having a thickness $t_{top1}$ measured in a vertical direction from the base material, such that $t_{top1}$ is greater than $t_{bot1}, t_{bot2}, \ldots t_{botn}$; and dielectric material separating the bottom and top spiral conductors; each turn of the at least one top spiral conductor being in axial alignment with a turn of the plurality of bottom spiral conductors, the inductor structure having a current path from a turn of the at least one top spiral conductor to an axially aligned turn of the plurality of bottom spiral conductors to a next turn of the plurality of bottom spiral conductors to an axially aligned turn of the at least one top spiral conductor to a next turn of the top spiral conductor and continuing until the current path has passed through all turns of the at least one top spiral conductor and the plurality of bottom conductors, wherein each of the plurality of bottom spiral conductors and at least one top spiral conductor each have a width and a turn to turn spacing measured in a direction parallel to the base material wherein the width of each of the plurality of bottom spiral conductors, $W_{thin}$, is greater than the width of the at least one top spiral conductor, $W_{thick}$, and wherein the turn to turn spacing of each of the plurality of bottom spiral conductors, $S_{thin}$, is smaller than the turn to turn spacing of the at least one top spiral conductor, $S_{thick}$, and wherein the inductor has an outside diameter, OD, and an inside diameter, ID, such that:

$$W_{thick}+S_{thick}=W_{thin}+S_{thin},$$

$ID=OD-(2)(n1)(W_{thick}+S_{thick})$ where n1=the number of turns, of the topmost conductor of the inductor structure, $S_{thin}$ is specified by design rules for minimum spacing, and $$W_{thin}=((OD-ID)/n1)-S_{thin}.$$

According to a third aspect of the exemplary embodiments, there is provided a method of designing an inductor structure. The method includes: providing an inductor structure comprising: a base material; at least one bottom spiral conductor disposed on the base material, of the at least one bottom spiral conductor having a thickness $t_{bot1}$, a width $w_{thin}$ and a turn to turn spacing $s_{thin}$; at least one top spiral conductor in contact with the at least one bottom spiral conductor, the at least one top spiral conductor having a thickness $t_{top1}$, a width $w_{thick}$ and a turn to turn spacing $s_{thick}$ wherein $M_{total}$ represents the total number of top spiral conductors; and dielectric material separating the bottom and top spiral conductors. The method further includes specifying the total number of turns, N, in the inductor structure; and determining the number of turns, n1, of the topmost conductor and the number of turns, n2, of the at least one bottom spiral conductor, such that n2 is $N/(M_{total}+1)$ where n2 is a whole number result of the division and any fractional remainder, R, left over from the division of $N/(M_{total}+1)$ is applied to n1, such that n1 is $N/(M_{total}+1)$ plus $1/M_{total}$ times the remainder R, wherein n1 may include fractional turns whereas n2 is only allowed to contain whole number of turns. The method is performed on one or more computing devices.

BRIEF DESCRIPTION OF SEVERAL VIEWS OF THE DRAWINGS

The features of the exemplary embodiments believed to be novel and the elements characteristic of the exemplary embodiments are set forth with particularity in the appended claims. The Figures are for illustration purposes only and are not drawn to scale. The exemplary embodiments, both as to organization and method of operation, may best be understood by reference to the detailed description which follows taken in conjunction with the accompanying drawings in which:

DETAILED DESCRIPTION

Figure 1A:
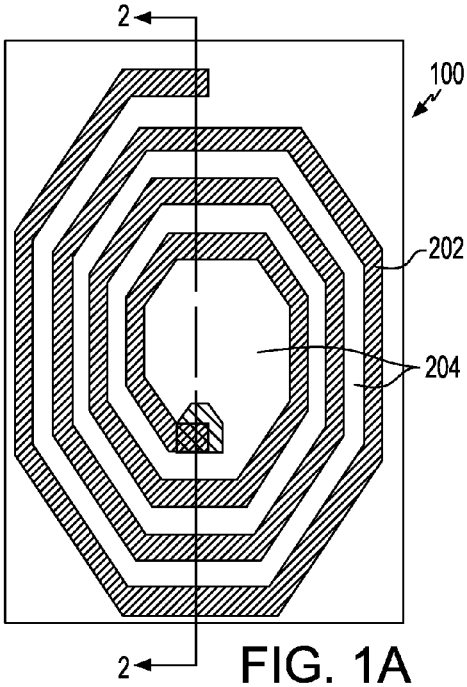
FIGS. 1A, 1B and 1C are plan views of a top spiral conductor, a middle spiral conductor and a bottom spiral conductor, respectively, according to exemplary embodiments.
Figure 1B:
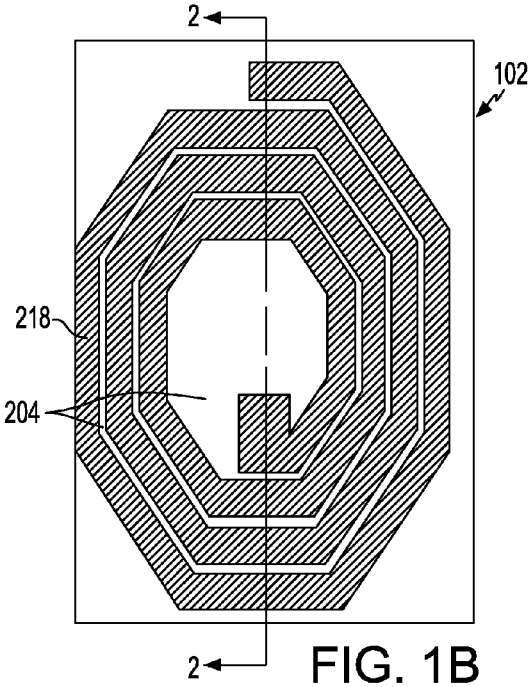
Figure 1C:
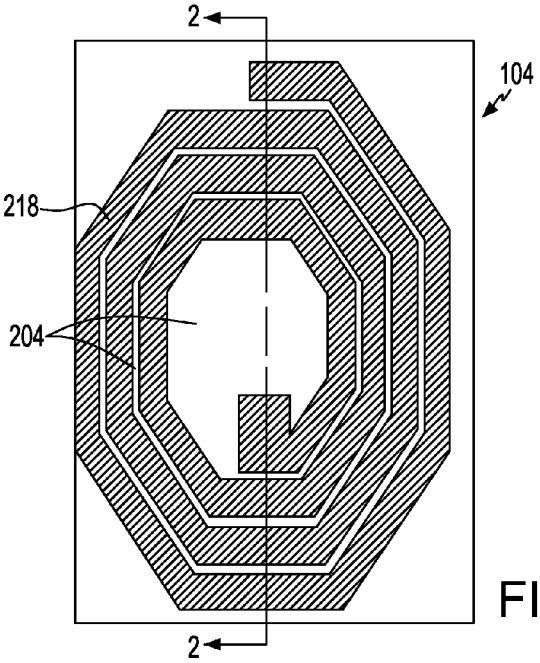

Referring first to FIGS. 1A, 1B and 1C, there are shown plan views of at least three conductors having spiral turns for use in fabricating an inductor of the exemplary embodiments. Throughout this specification, conductors having spiral turns may also be referred to as spiral conductors and both descriptions are deemed to be equivalent. FIG. 1A illustrates the spiral turns of a top conductor 100, FIG. 1B illustrates the spiral turns of a middle conductor 102 and FIG. 1C illustrates the spiral turns of a bottom conductor 104. There may be more than one bottom conductor layer 104. In use, the top spiral turns of conductor 100 would be placed on top of middle spiral turns of conductor 102 which would then be placed on top of the bottom spiral turns of conductor(s) 104. Dielectric material is formed between the spiral turns of the conductors 100, 102, and 104, between the various conductors 100, 102, and 104 to separate the spiral conductors 100, 102, and 104 and around the various conductors 100, 102 and 104 to separate them from adjacent electrical wiring.

The conductors 100, 102, and 104 in FIGS. 1A, 1B and 1C are for illustration of one exemplary embodiment and the number of spiral turns, width of the spiral turns and spacing of the spiral turns may vary in other exemplary embodiments shown in the following Figures.

Figure 2:
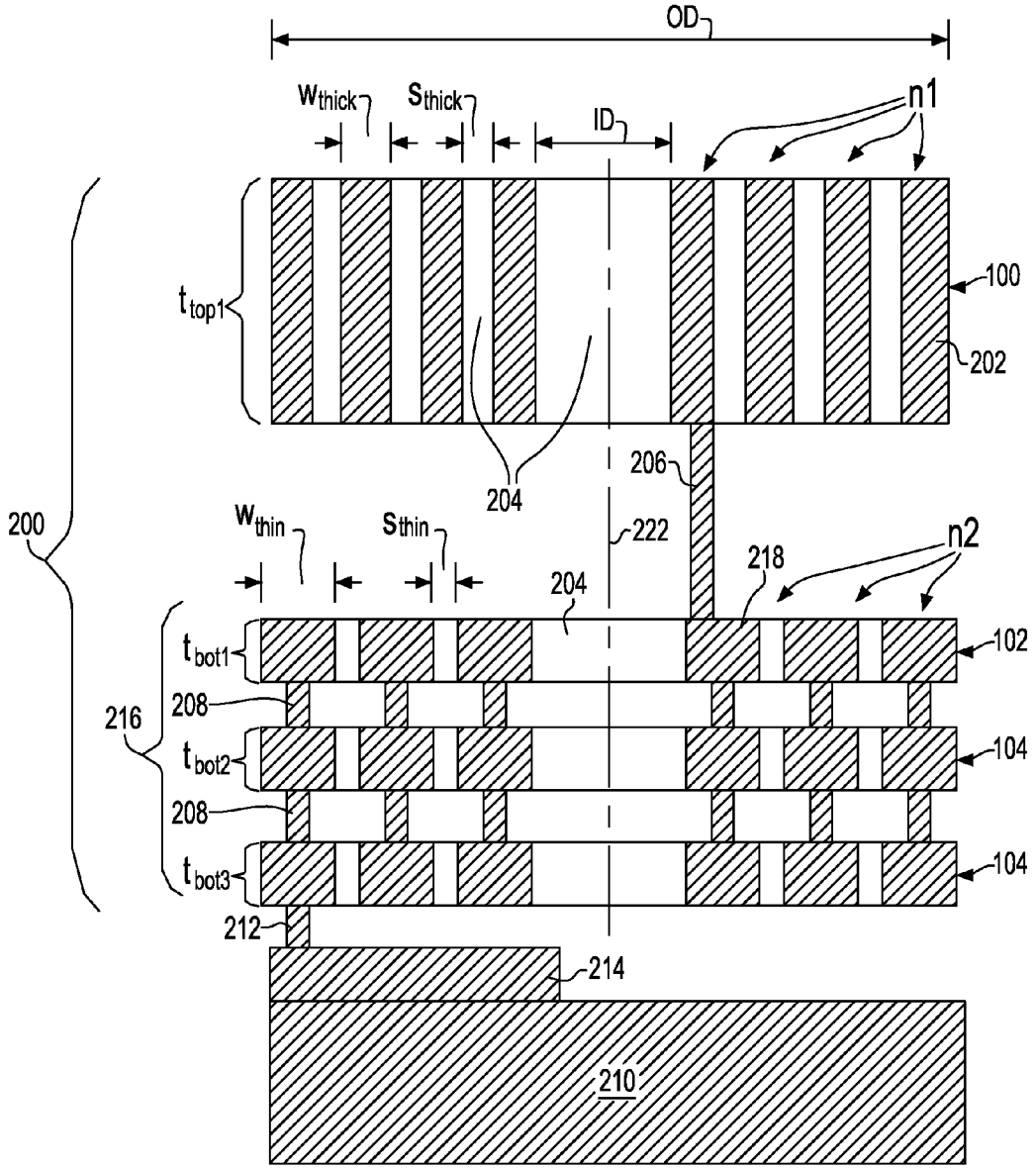
FIG. 2 is a cross sectional view of a multilayer inductor according to a first exemplary embodiment.

FIG. 2 illustrates a cross sectional view of an exemplary embodiment of an inductor 200 which includes the various spiral conductors 100, 102, 104 shown in FIG. 1 in the direction of arrows 2-2 plus insulating dielectric material and connecting vias. The number of spiral turns, width of the spiral turns and spacing of the spiral turns of each of the spiral conductors 100, 102, and 104 may differ in the following cross-sectional views for other exemplary embodiments when compared to the plan views provided for illustration purposes only in FIGS. 1A, 1B and 1C. Inductor 200 may include more than one bottom conductor 104. FIG. 2 shows an additional bottom conductor layer 104 and there may be additional bottom conductor layers 104 (not shown) to meet electrical design requirements.

Top spiral conductor 100 has low sheet resistance compared to the remaining conductors of the inductor 200. The top conductor 100 includes the spiral turns 202 which have conventional dielectric material 204 between the spiral turns 202. Top conductor 100 may be made from aluminum or copper.

Conductors 102 and 104 make up a group 216 of thin metallization layers comprising spiral turns 218 with conventional dielectric material 204 between the turns 218. The spiral turns 202 in conductor 100 have an equal or greater number of complete turns plus fractional turns than the spiral turns 218 in conductors 102 and 104. The conductors of group 216 have a higher sheet resistance than the conductor 100. The conductors of group 216 may be made from copper.

The top conductor 100 is electrically connected to middle conductor 102 by via 206. Middle conductor 102 is connected to bottom conductor 104 by vias 208. If there is more than one bottom conductor 104, then each of these conductors are also connected by vias 208. Vias 206 and 208 may be made from copper.

The inductor 200 is disposed on base 210 and may be connected to a metal inter-circuit connection 214 by via 212. Base 210 may be made from an insulating material or, more usually, it will be made from a semiconducting material. When base 210 is a semiconducting material, there will usually be metal wiring layers on the semiconducting material. These metal wiring layers are called the back end of the line layers and the inductor 200 may be formed in the back end of the line layers.

The top conductor 100 has a thickness $t_{top1}$ measured in a vertical direction from the base 210 while the middle conductor 102 has a thickness $t_{bot1}$ and bottom conductor(s) have thicknesses "$t_{bot2}$ and $t_{bot3}$" as shown in FIG. 2. The spiral turns 202 in conductor 100 have a width $w_{thick}$ measured in a direction parallel to the base 210 while the spiral turns 218 of conductor group 216 have a width $w_{thin}$ measured in a direction parallel to the base 210. The spiral turns 202 in conductor 100 have a number of turns "n1" indicating the number of complete turns plus fractional turns in the spiral while the spiral turns 218 of conductor group 216 have a number of turns "n2" indicating the number of complete turns plus fractional turns in that spiral. The spiral turns 202 in conductor 100 have a spacing "$s_{thick}$" measured in a direction parallel to the base 210 while the spiral turns 218 of conductor group 216 have a spacing "$s_{thin}$" measured in a direction parallel to the base 210. The top conductor 100 will have a thickness $t_{top1}$ which is greater than the thickness $t_{bot1}$ of middle conductor 102. The top conductor thickness $t_{top1}$ will also be thicker than the thicknesses $t_{bot2}$ and $t_{bot3}$, of the bottom spiral conductor(s) 104. The thicknesses $t_{bot1}$, $t_{bot2}$, and $t_{bot3}$ of the middle conductor 102 and bottom conductors 104 are not required to be equal. For purposes of illustration and not limitation, top conductor 100 may have a thickness of about 2 to 4 μm (micro-meters) while the middle conductor 102 and the bottom conductor(s) 104 each may have a thickness of about 0.2 to 1 μm.

The top spiral turns 202 will have a width $w_{thick}$ which is less than the width $w_{thin}$ of the spiral turns 218 of conductor group 216. For purposes of illustration and not limitation, the top spiral turns may have a width of about 5 μm to 10 μm while the conductor layers comprising the spiral turns 218 of conductor group 216 may each have a width of about 5 to 50 μm.

The spacing $s_{thin}$ of the spiral turns 218 of the conductor group 216 will be less than the spacing sthick of the spiral turns 202 of the top conductor 100.

In general, the widths and spacing of all of the parallel connected conductors 102 and 104 in each conductor group should have the same width, $w_{thin}$, and spacing, $s_{thin}$.

The number of turns n1 of the top spiral turns 202 will be greater than or equal to the number of turns n2 of the spiral turns 218 of spiral conductor group 216.

Thus, it can be seen that the top spiral turns 202 of conductor 100 will be thicker, narrower and less tightly wound than the spiral turns 218 of conductor group 216.

Top spiral conductor 100 will be connected electrically in series with middle conductor 102 by via 206. Middle conductor 102 will be connected electrically in parallel with bottom conductor 104 by multiple vias 208. If there is more than one bottom conductor 104, then each bottom conductor 104 will be connected in parallel by vias 208. Vias 208 may also be bars. Bottom conductors 104 may be added until the layers in the back end of the line wiring are exhausted or until the electrical design requirements are met.

The thicker but narrower top spiral turns 202 result in higher inductance and also higher Q. The spiral turns 218 have wider but thinner conductors. The wider conductor of the spiral turns 218 result in higher Q. However, the wider lower metals connected in parallel may reduce the inductance density. By using the advantage of the smaller conductor to conductor spacing and the wider conductor of the spiral turns 218, inductance density is improved.

Figure 3:
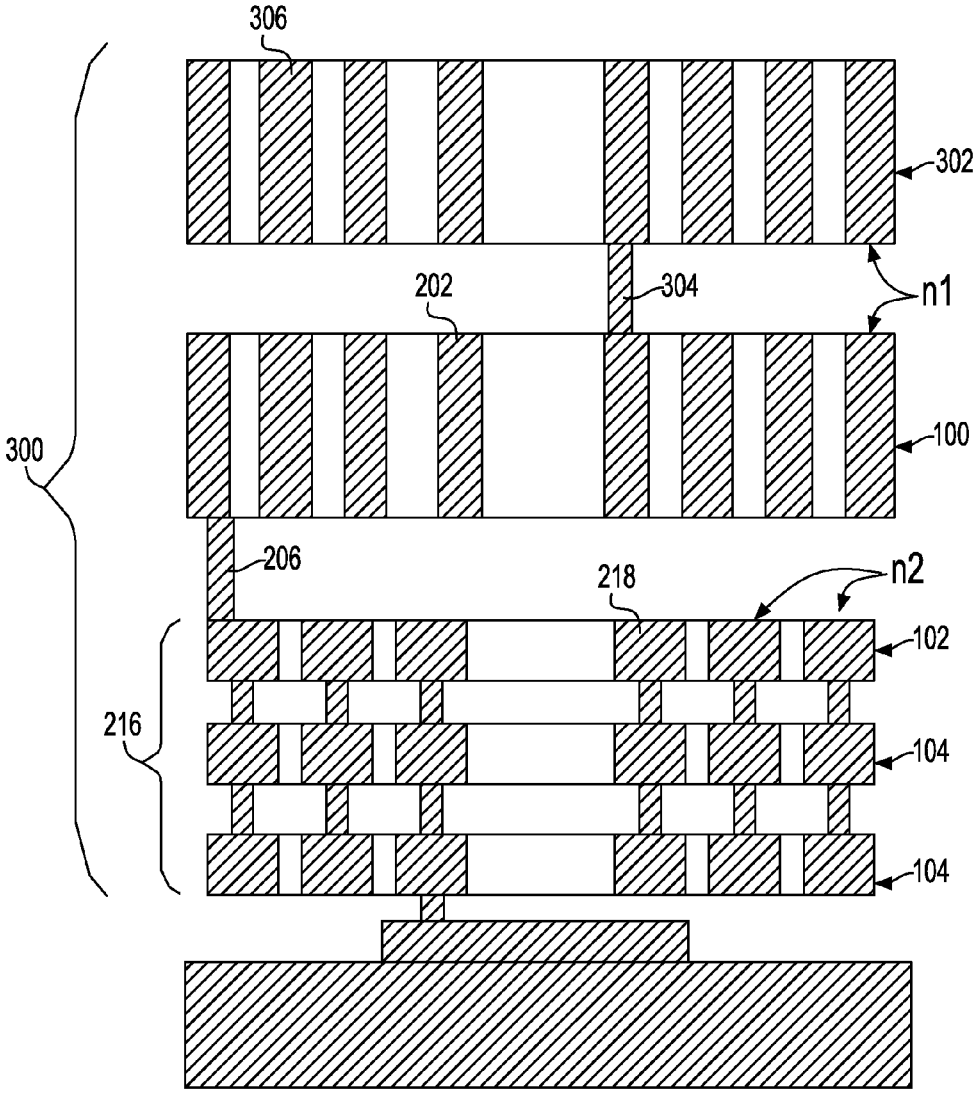
FIG. 3 is a cross sectional view of a multilayer inductor according to a second exemplary embodiment.

Referring now to FIG. 3, there is shown another exemplary embodiment of an inductor according to the present invention. Inductor 300 is similar to inductor 200 in FIG. 2 except that the inductor 300 in FIG. 3 now includes at least one additional top spiral conductor 302 comprising spiral turns 306. The top conductor 302 is connected electrically in series to top conductor 100. Top conductor 302 will be similar to top conductor 100 in that both top conductors 100 and 302 are comprised of thick conductors as compared to all conductors in spiral conductor group 216. The thicknesses of spiral conductors 100 and 302 are not required to be equal, nor are the width, space and number of turns of spiral turns 202 and 306 required to be equal. Both spiral turns 202 and 306 will satisfy the following relationships to all conductors in the spiral turns 218 of conductor group 216: 1) width of spiral turns 202 and spiral turns 306 are less than the width of spiral turns 218; 2) space of spiral turns 202 and spiral turns 306 are greater than the space of spiral turns 218; 3) number of turns of spiral turns 202 and spiral turns 306 is greater than or equal to the number of turns of spiral turns 218.

For the single thick metal embodiment shown in FIG. 2 and the dual thick metal embodiment shown in FIG. 3, and for embodiments (not shown) with $M_{total}$ (number of thick upper metal layers), the number of turns n1 (the number of turns in each of the $M_{total}$ thick metal layers) and n2 (the number of turns in the lower thin metal layer group) may be determined as follows. With reference to FIGS. 2 and 3 for examples of single thick and dual thick metal embodiments respectively, a designer may specify the total number of turns "N" in the inductor 200 (FIG. 2) or 300 (FIG. 3). In a preferred exemplary embodiment, the number of turns, n2, for each thin metal spiral in conductor group 216 is $N/(M_{total}+1)$ where n2 is the whole number result of the division. Any fractional remainder, R, left over from the division of $N/(M_{total}+1)$ is applied to n1. The number of turns, n1, for conductor 100 and conductor 202 (FIG. 2) or conductor 302 (FIG. 3) is $N/(M_{total}+1)$ plus $1/M_{total}$ times the remainder R. Thus, n1 may include fractional turns whereas n2 is only allowed to contain whole number of turns.

Referring to FIG. 2, there is illustrated the outside diameter and inside diameter of the spiral conductor 100. The various spiral conductors 102, 104 similarly have an outside diameter and an inside diameter which are not shown for clarity. Inductor 200 may also have a spiral axial centerline 222 indicating that half of the turns of the inductor 200 are on the left side of the spiral axial centerline 222 and the other half of the turns of the inductor 200 are on the right side of the spiral axial centerline 222. The other inductors shown herein may be similarly defined by the outside and inside diameters of the spiral inductors and the spiral axial centerline of the inductor.

Figure 7:
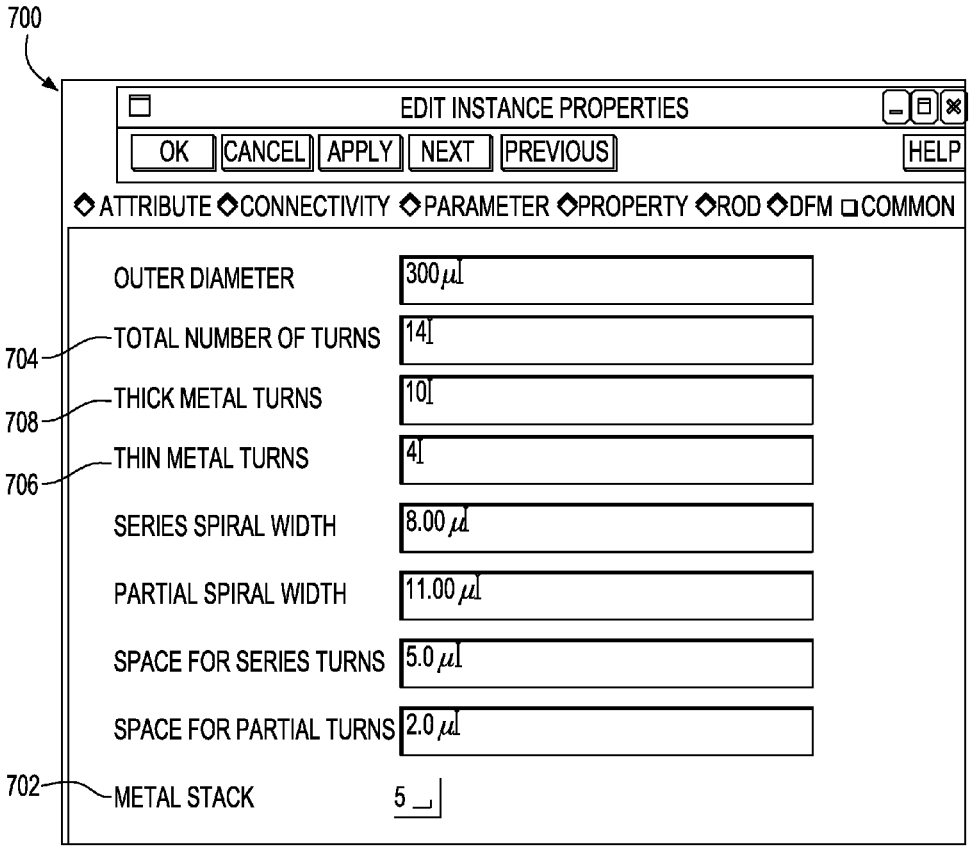
FIG. 7 is a user interface for determining the number of turns in a multilayer inductor.

Referring to FIG. 7, there is shown an exemplary interface 700 for determining the number of turns in a dual thick metal inductor. The interface may be used also for a single thick metal inductor with appropriate specification of the $M_{total}$ parameter, described in the paragraph above, to indicate the number of thick metal layers. Once the total number of turns, N, and the number of layers in the metal stack are entered, the number of turns for thick and thin metals may be determined. The metal stack is indicated at 702 as 5 layers, indicating that the inductor is dual thick metal layers and three thin metal spiral layers. The total number of turns, N, is indicated at 704 as being 14. A computing device may be used following the algorithm indicated above to determine the number of thin metal turns to be 4, indicated at 706. This number is arrived at by dividing N/3 or 14/3 giving a result of 4 and a remainder, R, of 2. The remainder is not included in the number of thin turns. The computing device may then be used to determine the number of thick metal turns in each of conductor 100 and 302 to be 5 each for a total of 10, indicated at 708. This number is arrived at by dividing N/3 or 14/3 plus 0.5 times the remainder of 2 which results in 5 turns for each of the thick metal layers The algorithm indicated above may be implemented by one or more computing devices comprised of a microprocessor, random access memory, read-only memory and other components. The computer may be a personal computer, mainframe computer, laptop computer or other computing device. Resident in the computer, or peripheral to it, may be a storage device of some type such as a hard disk drive, floppy disk drive, CD-ROM drive, tape drive or other storage device.

Generally speaking, the software implementation of the exemplary embodiments may be tangibly and nontransitorily embodied in a computer-readable medium such as one of the storage devices mentioned above. The software implementation may comprise instructions which, when read and executed by the microprocessor of the computing device may cause the computing device to perform the steps necessary to execute the steps or elements of the exemplary embodiments.

Figure 4:
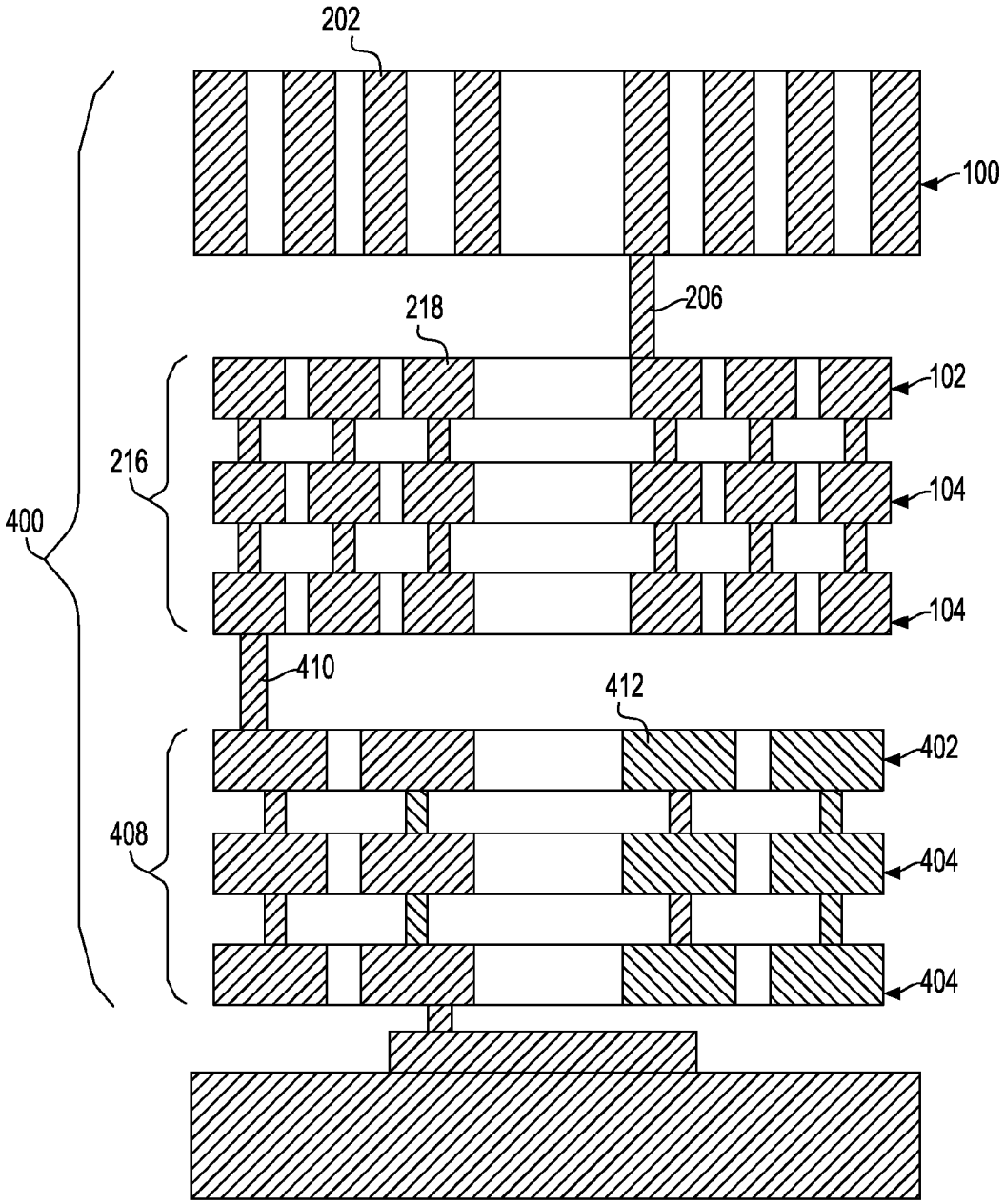
FIG. 4 is a cross sectional view of a multilayer inductor according to a third exemplary embodiment.

Referring now to FIG. 4, there is shown a further exemplary embodiment of an inductor according to the present invention. Inductor 400 is similar to inductor 200 in FIG. 2 with an additional spiral conductor group 408. As shown in FIG. 4, middle conductor 102 and bottom conductor(s) 104 make up a group 216 of thin metallization layers, comprising turns 218, which are connected electrically in series by via 206 to top spiral conductor 100, comprising turns 202, as was the case with inductor 200 in FIG. 2. Inductor 400 now includes at least one additional group 408, comprising turns 412 of thin metallization layers including middle conductor 402 and one or more bottom conductors 404. There may be other such groups 408 of thin metallization layers as electrical requirements may dictate and as the structure of the back end of the line wiring layers may allow (assuming the structure is built on a semiconductor base material). The thicknesses of conductors 102, 104, 402, and 404 are not required to be equal, nor are the width, space and number of spiral turns in conductor group 216 and the width, space and number of spiral turns in conductor group 408 required to be equal. Each spiral conductor layer in groups 216 and 408 may have different thicknesses from each other, with the single requirement being that all spiral conductors in groups 216 and 408 must be thinner than spiral conductor 100. Group 408 of thin metallization layers is connected electrically in series by via 410 to group 216 of thin metallization layers. Within group 408 of thin metallization layers, each of the thin metallization layers 402 and 404 are connected electrically in parallel. Spiral turns 202 will satisfy the following relationships to spiral turns 218 and 412: 1) width of spiral turns 202 is less than the width of spiral turns 218 and spiral turns 412; 2) space of spiral turns 202 is greater than the space of spiral turns 218 and spiral turns 412; 3) number of turns of spiral turns 202 is greater than or equal to the number of turns of spiral turns 218 and spiral turns 412.

Figure 5:
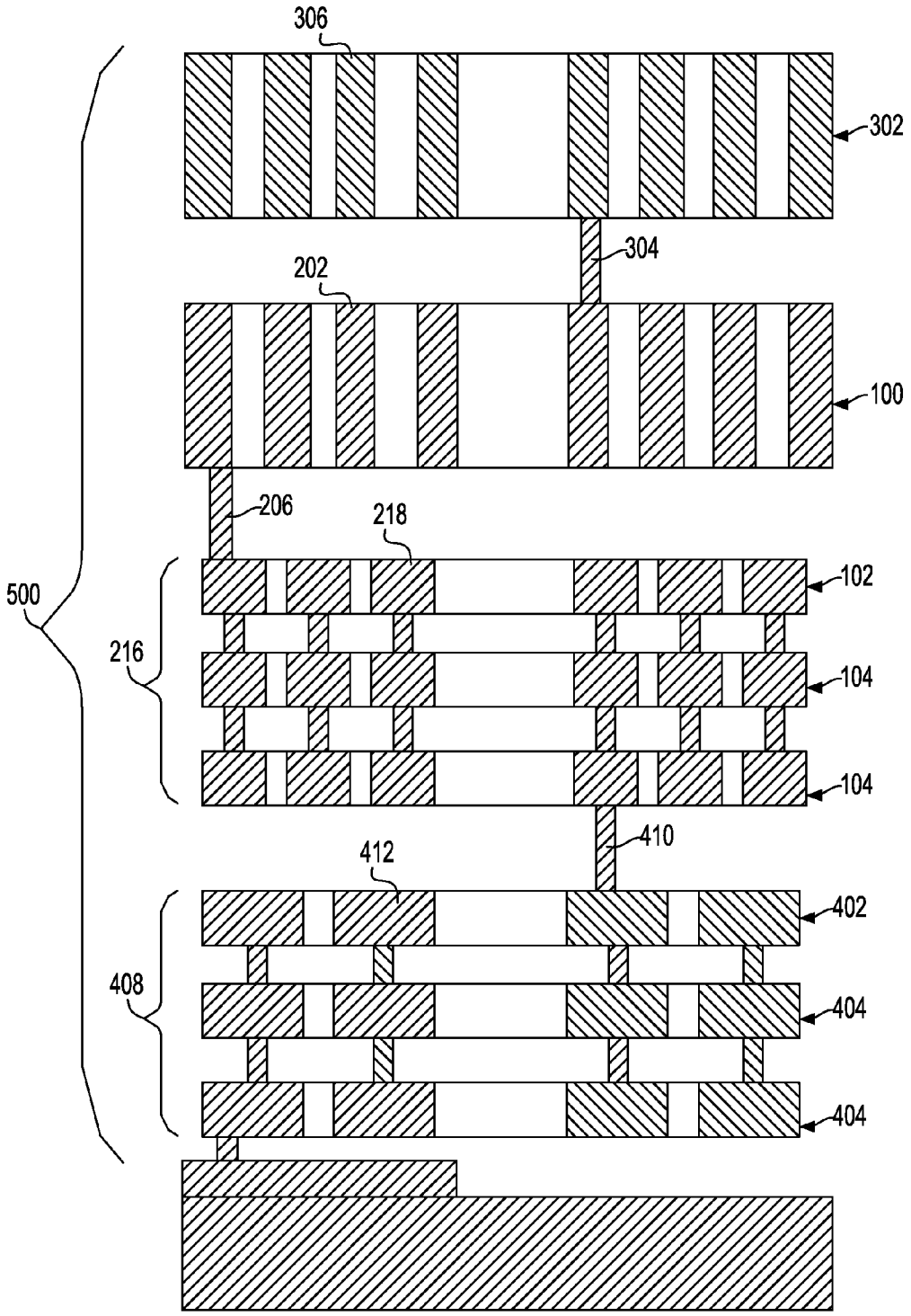
FIG. 5 is a cross sectional view of a multilayer inductor according to a fourth exemplary embodiment.

Referring now to FIG. 5, there is shown another exemplary embodiment of an inductor according to the present invention. Inductor 500 is similar to inductor 400 in FIG. 4 except that the inductor 500 in FIG. 5 now includes at least one additional top, thick spiral conductor 302, comprising spiral turns 306 similar to inductor 300. The thickness of spiral conductor 302 is not required to be equal to the thickness of spiral conductor 100. The top spiral conductor 302 is connected electrically in series to top spiral conductor 100 through via 304. Spiral turns 202 and spiral turns 306 will satisfy the following relationships to spiral turns 218 and spiral turns 412: 1) Width of spiral turns 202 and spiral turns 306 are less than the width of spiral turns 218 and spiral turns 412; 2) space of spiral turns 202 and spiral turns 306 are greater than the space of spiral turns 218 and spiral turns 412; 3) number of turns of spiral turns 202 and spiral turns 306 are greater than or equal to the number of turns of spiral turns 218 and spiral turns 412.

Various exemplary embodiments have been discussed above in regards to FIGS. 2 to 5. The present inventors have proposed a methodology for determining the type of conductor layers and whether the layers are connected electrically in series or parallel for the series parallel inductor of the exemplary embodiments. The methodology is presented in FIG. 6.

Figure 6:
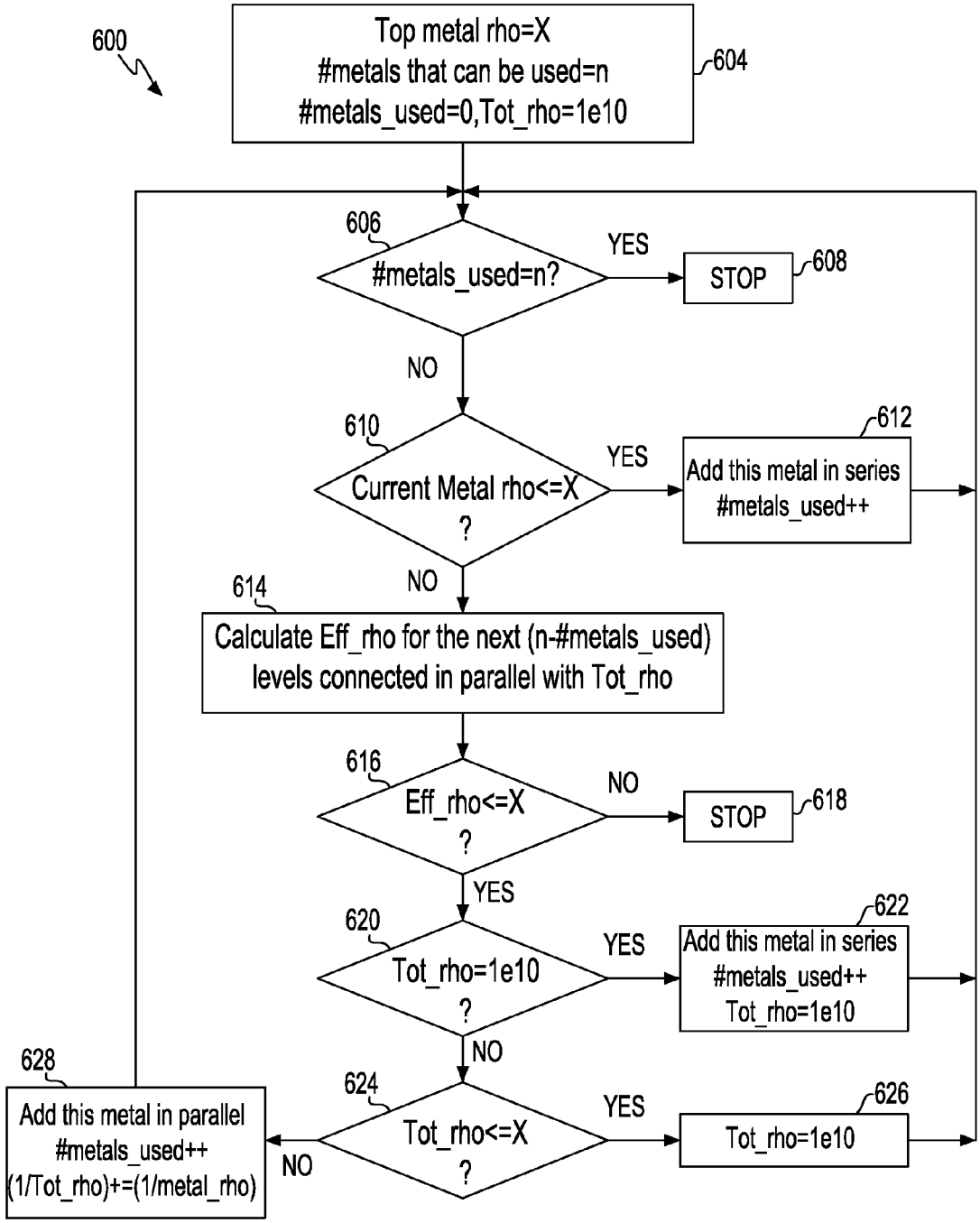
FIG. 6 is a flow chart of a process for optimizing quality factor Q and inductance.

Referring now to FIG. 6, the methodology 600 is described. First, parameters are initialized in box 604. The sheet resistance (rho) of the top spiral conductor is set to "X", the number of metallization layers is set to "n", the number of metallization layers used is set to "0" and the total sheet resistance ("total rho") of the inductor is set to a very large number such as $1\times10^{10}$.

It is next determined whether the number of metallization layers used thus far equals "n" as indicated in decision box 606. If the answer is "yes", the process stops, box 608, indicating that the available number of metallization layers have been utilized in forming the inductor and there are no more metallization layers available. If the answer is "no", the process continues.

It is necessary to determine the sheet resistance of the next metallization layer, decision box 610. If the sheet resistance of the metallization layer to be added is less than or equal to "X", then this is a top metallization layer and it is added in series, box 612. The number of metallization layers used is incremented. If the sheet resistance of the metallization layer to be added is greater than "X", then this is a thin metallization layer and the process continues to the next step.

In the next step, the effective sheet resistance for the remaining available thin metal layers (if any) connected in parallel with any thin metal layers already added in parallel is determined, box 614. This is done by calculating the effective parallel sheet resistance of the remaining thin metal layers placed in parallel with the value of Tot_rho, which represents the value of any already parallel connected thin metal layers.

If the effective sheet resistance calculated in box 614 is greater than the sheet resistance "X" of the top metallization layer, decision box 616, then sufficient thin metallization layers do not exist and the process stops, box 618. However, if the effective sheet resistance calculated in box 614 is less than or equal to the sheet resistance "X" of the top metallization layer, then the process proceeds to the next step to add more metallization layers.

It is next determined if the total rho (used later to calculate the total sheet rho due to multiple levels being connected in parallel) equals $1\times10^{10}$. When the first thin metallization layer is added and decision box 620 is encountered, the total rho of the inductor will equal the initialization value of $1\times10^{10}$ and so the "yes" path is taken. This first thin metallization layer will be connected to the previous thick metallization layer in series as indicated in FIGS. 2 to 5. Thereafter, the value of total rho is set to the sheet resistance of the thin metallization layer, the number of metallization layers is incremented and the thin metallization layer is added in series, box 622. The next time a thin metallization layer encounters decision box 620, total rho will have the value of the sheet resistance of the thin metallization layer which will be less than $1\times10^{10}$ and so the "no" path will be taken for the next thin metallization layer.

Thereafter, it is determined if the total rho is less than or equal to "X", decision box 624. If total rho is less than or equal to "X", the "yes" path is taken and total rho is given the value of $1\times10^{10}$, box 626. However, if the total rho is greater than the value of "X", then the "No" path is taken. The thin metallization layer is added in parallel and the number of metallization layers used is incremented, box 628. The equation in box 628—(1/total rho)+=(1/metal rho)—implies (1/total rho) =(1/total rho)+(1/metal/rho) which essentially is calculating the reduction in the total sheet resistance due to the addition of the current thin metal in parallel.

The process continues until all thick and thin metallization layers have been added electrically in parallel or series and the number of metallization layers equals the number of metallization layers available for the spiral.

It should be understood that the inductors shown in FIGS. 1 to 5 only reflect part of the semiconductor structure when built on a semiconductor base. The semiconductor structure may also include transistors, capacitors, resistors, etc. which are not shown for clarity. It is also understood that after formation of the inductors shown herein, normal semiconductor processing may proceed.

Figure 8:
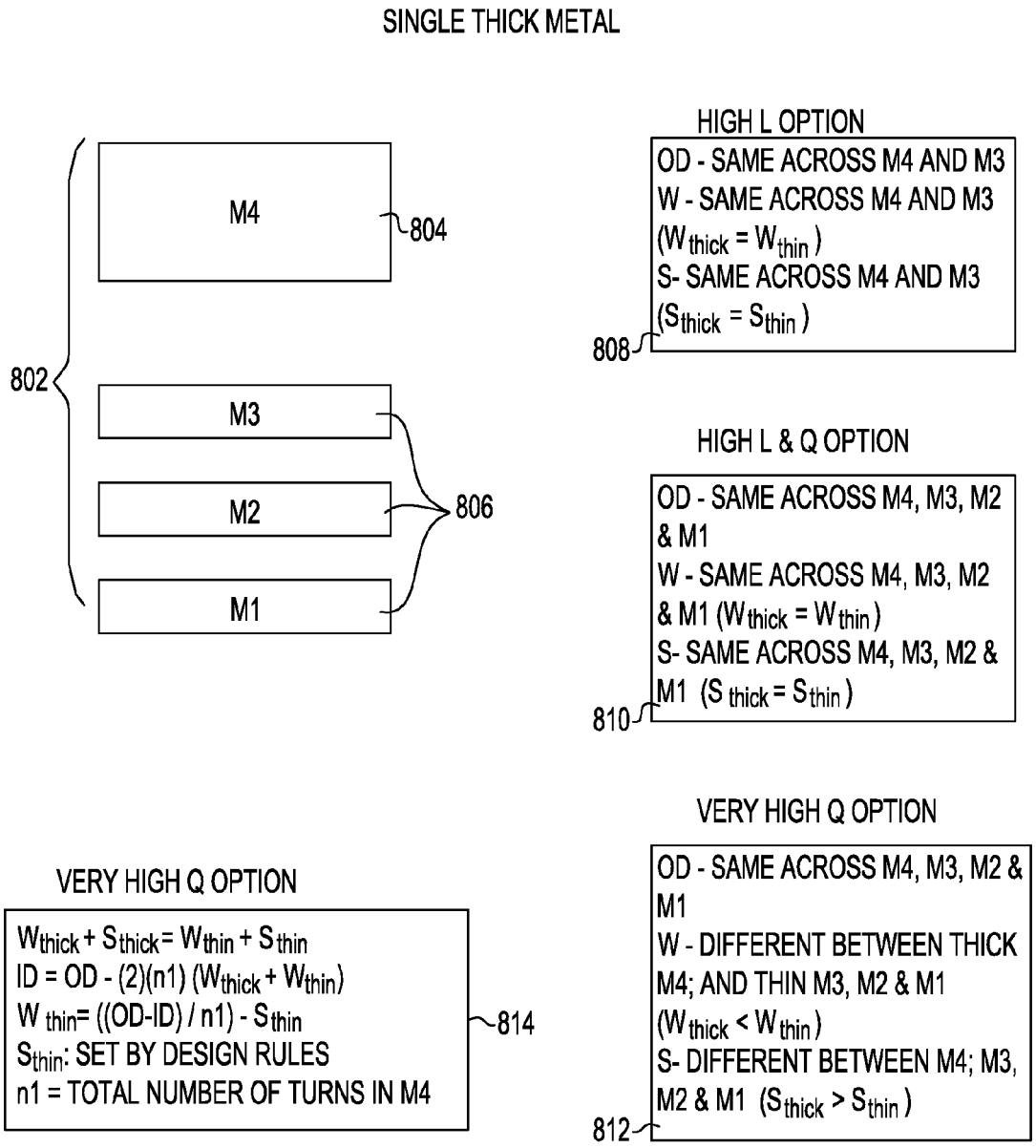
FIG. 8 is a chart illustrating various inductor options for an inductor having a single thick metal for a top spiral inductor layer.

Referring now to FIG. 8, there are shown various options for a single thick metal inductor. On the left side of FIG. 8, there is schematically shown a multilayer stack of metal layers 802 for an inductor structure comprising a single thick metal layer 804 (M4) and three thin metal layers 806 (M1, M2, M3). Each of the metal layers 804, 806 comprises the layer in which the spiral inductors may be formed. Thus, the bottom spiral conductors may be formed in the three thin metal layers 806 while the top spiral conductor may be formed in the thick metal layer 804. The various options include a high L option 808 which may only include metal layers M4 and M3, a high L & Q option 810 which may include all of metal layers M1 to M4 and a very high Q option 812 which also may include all of metal layers M1 to M4. The very high Q option 812 has a different form factor for the width W of each of the turns and the spacing S between the turns than the high L & Q option 810.

In the case of the very high Q option 812, there may be special relationships 814 for the width and turn to turn spacing of the various metal layers 804, 806. Precise dimensions for the width and turn to turn spacing of the various spiral inductors for the very high Q option may be determined in the following manner.

$$W_{thick}S_{thick}=W_{thin}S_{thin}$$

For both thick and thin spiral inductors:

Inside Diameter (ID)=Outside Diameter (OD)−(2)(n1)($W_{thick}$+$S_{thick}$) where n1=the number of turns of the topmost conductor of the inductor structure Spacing at thin metals=$S_{thin}$ (specified by design rules for minimum spacing)

$$W_{thin}=(OD-ID)/n1)-S_{thin}.$$

In general, $S_{thin}<S_{thick}$ and $W_{thin}>W_{thick}$.

Figure 9:
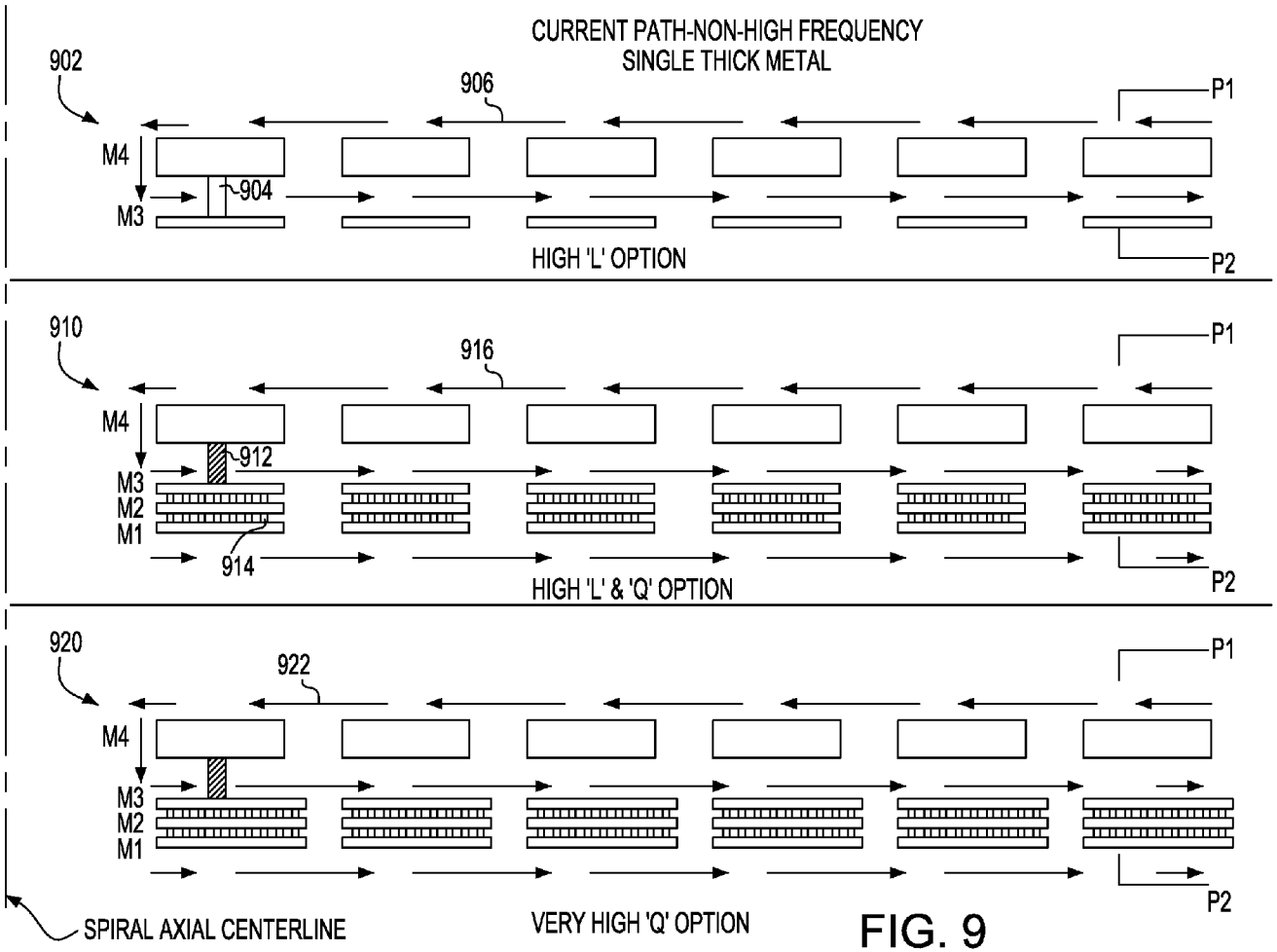
FIG. 9 illustrates a current path for each of the inductor options in FIG. 8.

FIG. 9 illustrates one method of electrically connecting the various layers in a non-high frequency manner to result in a current path for each of the options shown in FIG. 8. FIG. 9 is in cross-section across the inductor so each turn of the inductor may be seen. FIG. 9 also shows only half of the inductor spiral for simplicity, as indicated by the spiral axial centerline, since the spiral has approximate axial symmetry. For the high L option 902, thick metal layer M4 may be connected to thin metal layer M3 by a via 904. The current path for this high L option is indicated by arrows 906. The current path 906 is from electrode P1 across the thick metal spiral conductor layer M4, down through via 904, and then across thin metal spiral conductor layer M3 to electrode P2. All of thick metal spiral conductor layer M4, via 904 and thin metal spiral conductor layer M3 are electrically connected in series and thus the current path 906 to thin metal spiral conductor layer M3 is entirely in series.

For the high L & Q option 910, thick metal layer M4 may be connected to thin metal layer M3 by a via 912. Each of thin metal layers M3, M2, M1 may be connected by a plurality of vias 914. The current path for this high Q option is indicated by arrows 916. The current path 916 is from electrode P1 across the thick metal spiral conductor layer M4, down through via 912, and into the thin metal spiral conductor layers M3, M2, M1. M4 is connected to M3 in series. As all of the thin metal spiral conductor layers M3, M2, M1 are connected in parallel, the current path 916 is electrically in parallel to electrode P2. All of thick metal spiral conductor layer M4, via 904 and thin metal spiral conductor layer M3 are connected in series after which the current path 916 becomes a parallel circuit.

For the very high Q option 920, the current path 922 is essentially the same as the current path 916 of the high L & Q option 910. The inductance density remains approximately the same as the High L (902) and the High L & Q (910) options due to a constant pitch (width plus space) in turns M4 and M1, M2, M3. The Q is increased by increasing the width of layers M1, M2, M3, while decreasing the turn to turn space, maintaining the turn pitch. These wider turns M1, M2, M3 present a lower series resistance to the current path 922, increasing Q.

Figure 10:
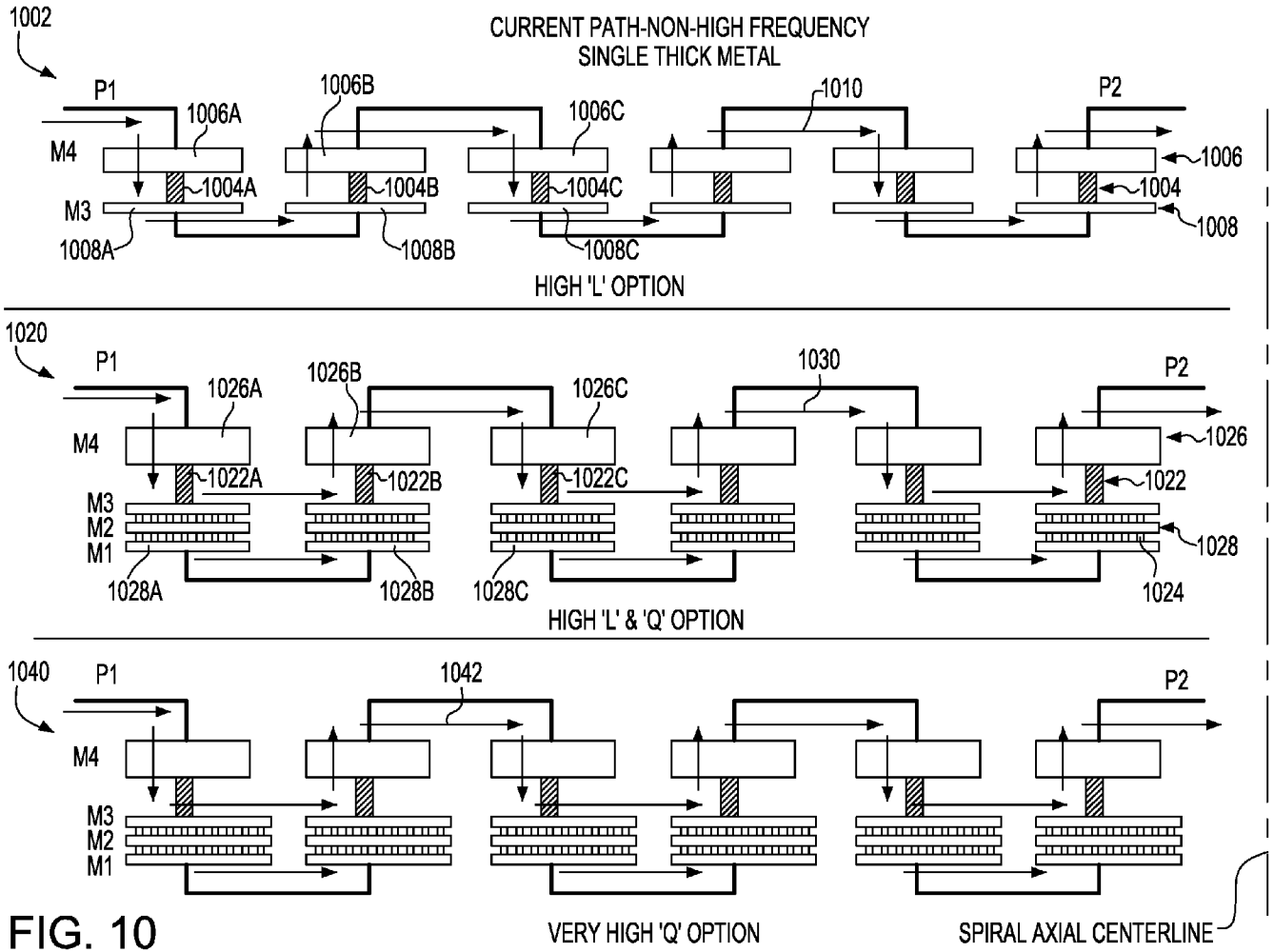
FIG. 10 illustrates another current path for high frequency operation for each of the inductor options in FIG. 8.

In a preferred exemplary embodiment, the various options shown in FIG. 8 may be electrically connected for high frequency operation as shown in FIG. 10. High frequency operation means operation at a higher frequency than was achievable with the FIG. 9 (non-high frequency) structures. The high frequency performance of the FIG. 9 structures is limited by the turn to turn capacitance, which causes the structure to self-resonate, rendering it useless above a certain frequency. The FIG. 10 structures minimize turn to turn capacitance, increasing the self-resonance frequency and enhancing the high frequency performance.

As can be seen in FIG. 10, the current path for the high frequency operation is rearranged so that there is current flowing between the various metal layers in each turn of the spiral conductor. Referring first to the high L option 1002, thick metal layer M4 may be connected to thin metal layer M3 at each turn by a via 1004. For the particular high L option 1002, there are six turns in each of the thick and thin metal layers and each turn of thick metal layer M4 is approximately aligned with a turn of the thin metal layer M3. The current path 1010 is from electrode P1 to turn 1006A of thick top spiral metal layer M4 (1006A), through via 1004A to thin bottom spiral metal layer M3 (1008A). The current path proceeds to an adjacent turn of thin bottom spiral metal layer M3 (1008B), up through via 1004B to thick top spiral metal layer M4 (1006B). Continuing, the current path 1010 may proceed across to an adjacent turn of thick top spiral metal layer M4 (1006C), down through via 1004C to thin bottom spiral metal layer M3 (1008C) and so on until all of the turns have been connected and ending in connection to electrode P2. As can be seen, each turn 1006A, 1006B and 1006C of thick top spiral metal layer M4 is approximately aligned with each turn 1008A, 1008B and 1008C, respectively, of thin bottom spiral metal layer M3. All of the layers and vias are connected in series.

Referring now to the high L & Q option 1020, thick metal layer M4 may be connected to thin metal layer M3 at each turn by a via 1022. Thin metal layers M3, M2, M1 may be connected to each other at each turn by a plurality of vias 1024. For the particular high L & Q option 1020, there are six turns in each of the thick and thin metal layers and each turn of thick metal layer M4 is approximately aligned with a turn of the thin metal layers M3, M2, M1. The current path 1030 is from electrode P1 to turn 1026A of thick top spiral metal layer M4 (1026A), through via 1022A to thin bottom spiral metal layers M3, M2, M1 (1028A). Thin bottom spiral metal layers M3, M2, M1 1028 are connected in parallel. The current path proceeds in parallel to an adjacent turn of thin bottom spiral metal layers M3, M2, M1 (1028B), up through via 1022B to thick top spiral metal layer M4 (1026B). Continuing, the current path 1030 may proceed across to an adjacent turn of thick top spiral metal layer M4 (1026C), down through via 1022C to thin bottom spiral metal layers M3, M2, M1 (1028C) and so on until all of the turns have been connected and ending in connection to electrode P2. As can be seen, each turn 1026A, 1026B and 1026C of thick top spiral metal layer M4 is approximately aligned with each turn 1028A, 1028B and 1028C, respectively, of thin bottom spiral metal layers M3, M2, M1.

For the Very High Q option 1040, the current path 1042 is essentially the same as the high L & Q option 1020. It should be noted that due to the different form factor between the thick and thin metal layers, the turns for the thick top spiral metal layers may be somewhat offset from the turns of the thin bottom spiral metal layers but they are viewed to be approximately aligned. Similarly to the Very High Q option 920 in FIG. 9, Q is increased, while maintaining inductance density by increasing the width of the parallel stacked M1, M2, M3 turns, while reducing their turn to turn space.

Figure 11:
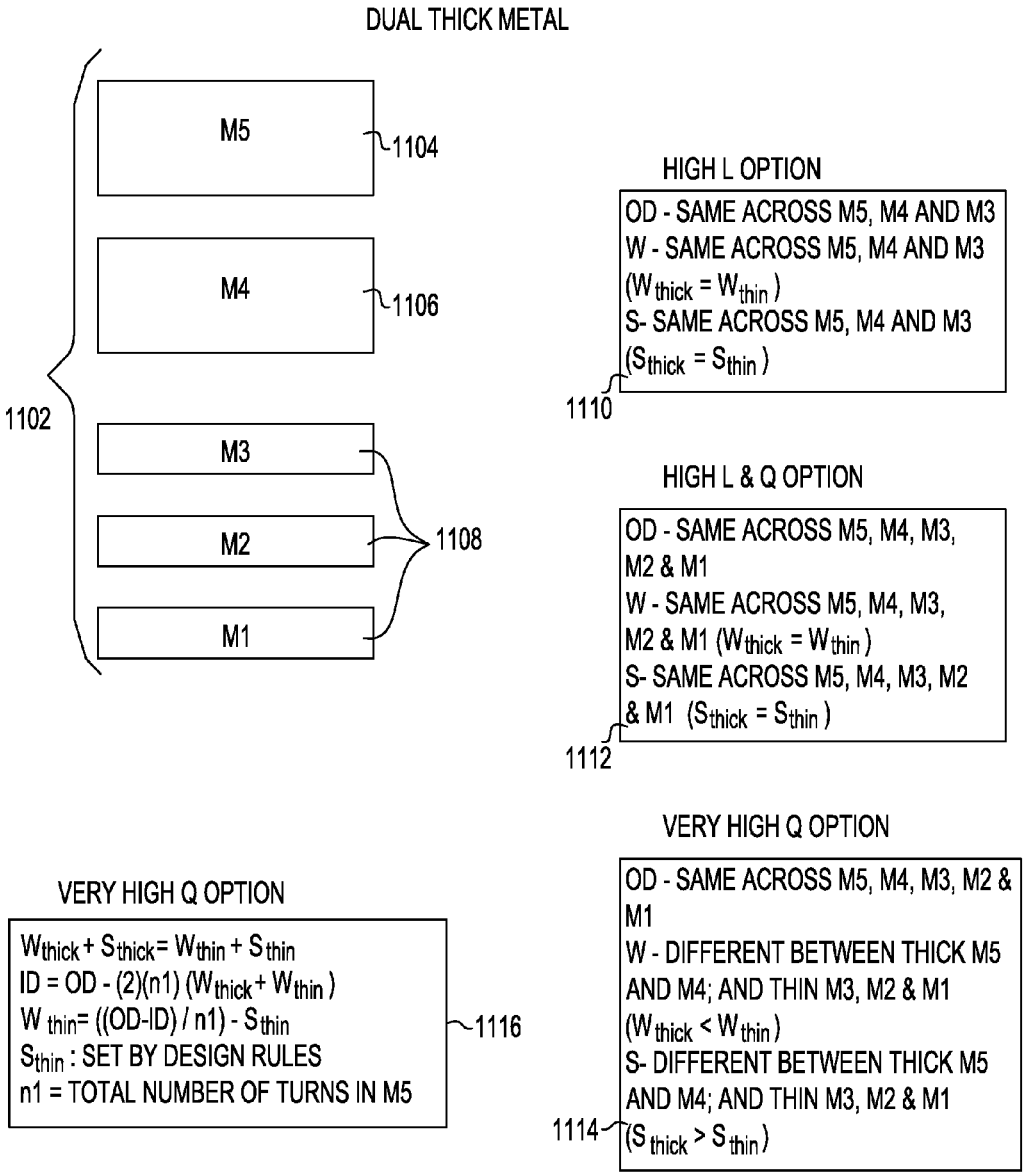
FIG. 11 is a chart illustrating various inductor options for an inductor having dual thick metal for top spiral inductor layers.

Referring now to FIG. 11, there are shown various options for a dual thick metal inductor. On the left side of FIG. 11, there is schematically shown a multilayer stack of metal layers 1102 for an inductor structure comprising dual thick metal layers 1104 (M5) and 1106 (M4) and three thin metal layers 1108 (M1, M2, M3). Each of the metal layers 1104, 1106, 1108 comprises the layer in which the spiral inductors may be formed. Thus, the bottom spiral conductors may be formed in the three thin metal layers 1108 while the top spiral conductors may be formed in the dual thick metal layers 1104, 1106. The various options include a high L option 1110 which may only include metal layers M5, M4 and M3, a high L & Q option 1112 which may include all of metal layers M1 to M5 and a very High Q option 1114 which also may include all of metal layers M1 to M5. The very high Q option 1114 has a different form factor for the width W of each of the turns and the spacing S between the turns than the high L & Q option 1112. In the case of the very high Q option 1114, there may be special relationships 1116 for the width and turn to turn spacing of the various metal layers 1104, 1106, 1108. Precise dimensions for the width and turn to turn spacing of the various spiral inductors for the very high Q option may be determined in the following manner.

$$W_{thick}S_{thick}=W_{thin}S_{thin}$$

For both thick and thin spiral inductors:

Inside Diameter (ID)=Outside Diameter (OD)−(2)(1)($W_{thick}$+$S_{thick}$) where n1=the number of turns of the topmost conductor of the inductor structure Spacing at thin metals=$S_{thin}$ (specified by design rules for minimum spacing)

$$W_{thin}=(OD-ID)/n1)-S_{thin}.$$

In general, $S_{thin}<S_{thick}$ and $W_{thin}>W_{thick}$.

Figure 12:
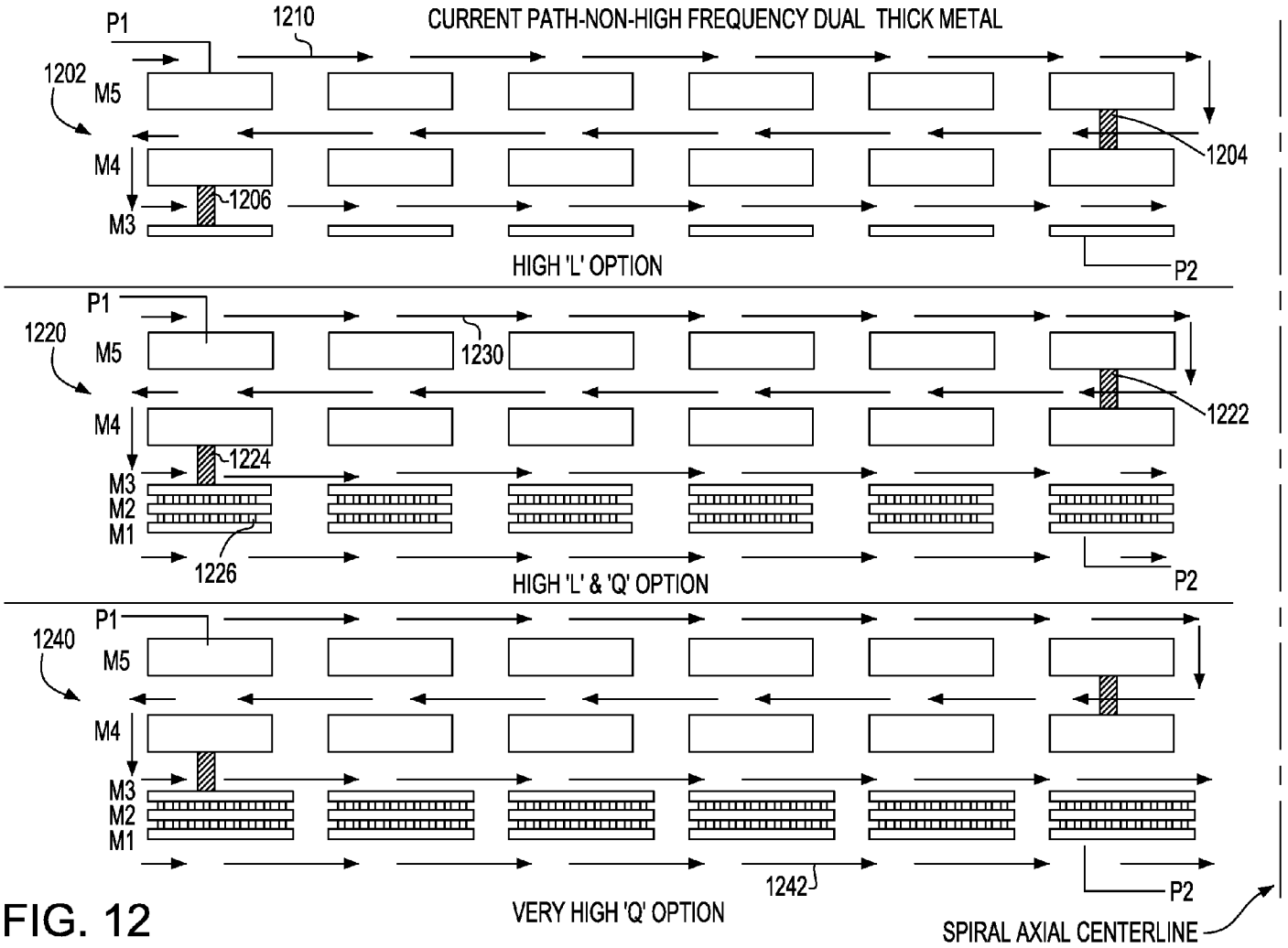
FIG. 12 illustrates a current path for each of the inductor options in FIG. 11.

FIG. 12 illustrates one method of electrically connecting the various layers in a non-high frequency manner to result in a current path for each of the options shown in FIG. 11. FIG. 12 is in cross-section across half of the inductor, as indicated by the spiral axial centerline, so each turn of the inductor may be seen. For the high L option 1202, thick metal layer M5 may be connected to thick metal layer M4 by a via 1204 and then to thin metal layer M3 by a via 1206. The current path for this high L option is indicated by arrows 1210. The current path 1210 is from electrode P1 across the thick metal spiral conductor layer M5, down through via 1204, back across the thick metal spiral conductor layer M4, down through via 1206 and then across thin metal spiral conductor layer M3 to electrode P2. All of thick metal spiral conductor layer M5, via 1204, thick metal spiral conductor layer M4, via 1206 and thin metal spiral conductor layer M3 are electrically connected in series and thus the current path 1210 is entirely electrically in series.

For the high L & Q option 1220, thick metal layer M5 may be connected by via 1222 to thick metal layer M4 which may be connected to thin metal layer M3 by a via 1224. Each of thin metal layers M3, M2, M1 may be connected by a plurality of vias 1226. The current path for this high Q option is indicated by arrows 1230. The current path 1230 is from electrode P1 across the thick metal spiral conductor layer M5, down through via 1222 to thick metal spiral conductor layer M4, down through via 1224, and into the thin metal spiral conductor layers M3, M2, M1. M5 and M4 are electrically connected to M3 in series. As all of the thin metal spiral conductor layers M3, M2, M1 are connected in parallel, the current path 1230, through the lowest spiral layer is in parallel to electrode P2. All of thick metal spiral conductor layer M5, via 1222, thick metal spiral conductor layer M4, via 1224 and thin metal spiral conductor layer M3 are connected in series and thus the current path 1230 to thin metal spiral conductor layer M3 is entirely in series, after which the current path becomes a parallel circuit.

Figure 13:
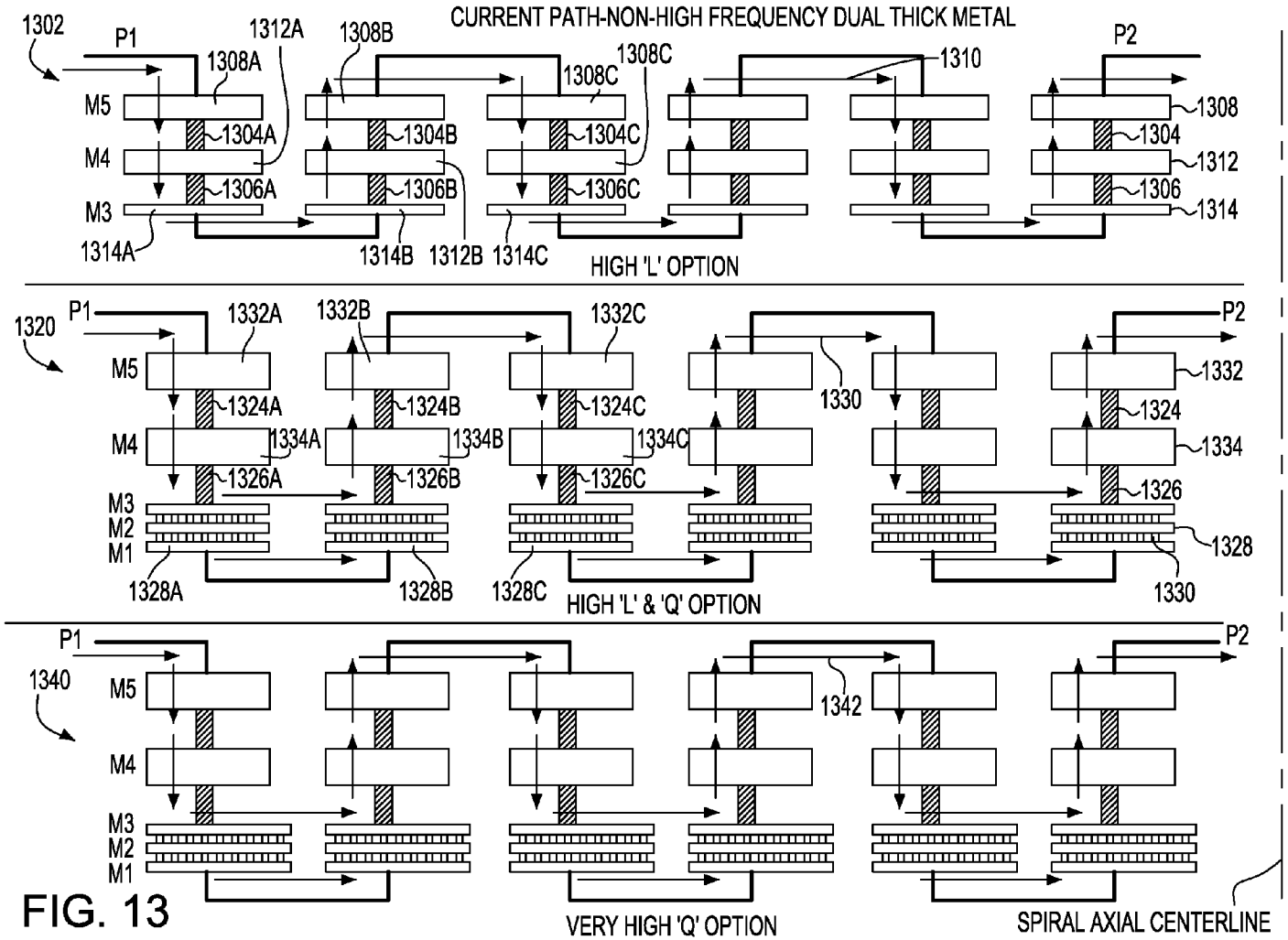
FIG. 13 illustrates another current path for high frequency operation for each of the inductor options in FIG. 11.

For the very high Q option 1240, the current path 1242 is essentially the same as the high L & Q option 1220. Similarly to the Very High Q options 920 in FIG. 9 and 1040 in FIG. 10, Q is increased, while maintaining inductance density by increasing the width of the parallel stacked M1, M2, M3 turns, while reducing their turn to turn space In a preferred exemplary embodiment, the various options shown in FIG. 11 may be electrically connected for high frequency operation as shown in FIG. 13. As can be seen in FIG. 13, the current path for the high frequency operation is rearranged so that there is current flowing between the various metal layers in each turn of the spiral conductor as was the case with the single thick metal embodiments illustrated in FIG. 10. Referring first to the high L option 1302, thick metal layer M5 may be connected to thick metal layer M4 at each turn by a via 1304 and thick metal layer M4 may be connected to thin metal layer M3 at each turn by a via 1306. For the particular high L option 1302, there are six turns in each of the thick and thin metal layers and each turn of thick metal layers M5 and M4 is approximately aligned with a turn of the thin metal layer M3. The current path 1310 is from electrode P1 to turn 1308A of thick top spiral metal layer M5 (1308A), through via 1304A to turn 1312A of thick top spiral metal layer M4 (1312A), through via 1306A to thin bottom spiral metal layer M3 (1314A). The current path proceeds to an adjacent turn of thin bottom spiral metal layer M3 (1314B), up through via 1306B to thick top spiral metal layer M4 (1312B), up through via 1304B to thick top spiral metal layer M5 (1308B). Continuing, the current path 1310 may proceed across to an adjacent turn of thick top spiral metal layer M5 (1308C), down through via 1304C to thick top spiral metal layer M4 (1312C), down through via 1306C to thin bottom spiral metal layer M3 (1314C) and so on until all of the turns have been connected and ending in connection to electrode P2. As can be seen, each turn 1308A, 1308B and 1308C of thick top spiral metal layer M5 and each turn 1312A, 1312B and 1312C of thick top spiral metal layer M4 is approximately aligned with each turn 1312A, 1312B and 1312C, respectively, of thin bottom spiral metal layer M3. All of the layers and vias are connected in series.

Referring now to the high L & Q option 1320, thick metal layer M5 may be connected to thick metal layer M4 at each turn by a via 1324 and thick metal layer M4 may be connected to thin metal layer M3 at each turn by a via 1326. Thin metal layers M3, M2, M1 may be connected to each other at each turn by a plurality of vias 1330. For the particular high L & Q option 1320, there are six turns in each of the thick and thin metal layers and each turn of thick metal layers M4 and M5 is approximately aligned with a turn of the thin metal layers M3, M2, M1 (1328).

The current path 1330 is from electrode P1 to turn 1332A of thick top spiral metal layer M5 (1332A), through via 1324A to turn 1334A of thick top spiral metal layer M4 (1334A), through via 1326A to thin bottom spiral metal layers M3, M2, M1 (1328A). Thin bottom spiral metal layers M3, M2, M1 1328 are connected in parallel. The current path proceeds in parallel to an adjacent turn of thin bottom spiral metal layers M3, M2, M1 (1328B), up through via 1326B to thick top spiral metal layer M4 (1334B), up through via 1324B to thick top spiral metal layer M5 (1332B). Continuing, the current path 1330 may proceed across to an adjacent turn of thick top spiral metal layer M5 (1332C), down through via 1324C to, thick top spiral metal layer M4 (1334C), down through via 1326C to thin bottom spiral metal layers M3, M2, M1 (1328C) and so on until all of the turns have been connected and ending in connection to electrode P2. As can be seen, each turn 1332A, 1332B and 1332C of thick top spiral metal layer M5 and each turn 1334A, 1334B and 1334C of thick top spiral metal layer M4 is approximately aligned with each turn 1328A, 1328B and 1328C, respectively, of thin bottom spiral metal layers M3, M2, M1.

For the very high Q option 1340, the current path 1342 is essentially the same as the high Q option 1320. It should be noted that due to the different form factor between the thick and thin metal layers, the turns for the thick top spiral metal layers may be somewhat offset from the turns of the thin bottom spiral metal layers but they are viewed to be approximately aligned. Similarly to the Very High Q options 920 in FIGS. 9 and 1040 in FIGS. 10, and 1240 in FIG. 12, Q is increased, while maintaining inductance density by increasing the width of the parallel stacked M1, M2, M3 turns, while reducing their turn to turn space It will be apparent to those skilled in the art having regard to this disclosure that other modifications of the exemplary embodiments beyond those embodiments specifically described here may be made without departing from the spirit of the invention. Accordingly, such modifications are considered within the scope of the invention as limited solely by the appended claims.

What is claimed is:

1. An inductor structure comprising:

a base material;

a plurality of bottom spiral conductors having a first number of turns n2 of the spiral disposed on the base material, the plurality of bottom spiral conductors having thicknesses $t_{bot1}$, $t_{bot2}$, . . . $t_{botn}$ measured in a vertical direction from the base material and a width $W_{thin}$ and a turn to turn spacing $S_{thin}$, wherein width $W_{thin}$ and turn to turn spacing $S_{thin}$ are measured in a direction parallel to the base material;

at least one top spiral conductor having a second number of turns n1 of the spiral in contact with the plurality of bottom spiral conductors, the at least one top spiral conductor having a thickness $t_{top1}$ measured in a vertical direction from the base material, a width $W_{thick}$ and a turn to turn spacing $S_{thick}$ wherein the width $W_{thick}$ and turn to turn spacing $S_{thick}$ being measured in a direction parallel to the base material, such that $t_{top1}$ is greater than $t_{bot1}$, $t_{bot2}$, . . . $t_{botn}$; and dielectric material separating the bottom and top spiral conductors;

each turn of the at least one top spiral conductor being in axial alignment with a turn of the plurality of bottom spiral conductors, the inductor structure having a current path from a turn of the at least one top spiral conductor to an axially aligned turn of the plurality of bottom spiral conductors to a next turn of the plurality of bottom spiral conductors to an axially aligned turn of the at least one top spiral conductor to a next turn of the top spiral conductor and continuing until the current path has passed through all turns of the at least one top spiral conductor and the plurality of bottom conductors;

wherein the width of each of the plurality of bottom spiral conductors, $W_{thin}$, is greater than the width of the at least one top spiral conductor, $W_{thick}$, and wherein the turn to turn spacing of each of the plurality of bottom spiral conductors, $S_{thin}$, is smaller than the turn to turn spacing of the at least one top spiral conductor, $S_{thick}$, and wherein the inductor has an outside diameter, OD, and an inside diameter, ID, such that:

$W_{thick}+S_{thick}=W_{thin}+S_{thin}$, $ID=OD-(2)(n1)(W_{thick}\ S_{thick})$ where n1=the number of turns of the topmost conductor of the inductor structure, $S_{thin}$ is specified by design rules for minimum spacing, and $W_{thin}=((OD-ID)/n1)-S_{thin}$.

2. The inductor of claim 1 wherein there are a plurality of top spiral conductors each having a width, $W_{thick}$, and a turn to turn spacing of $S_{thick}$.

3. An inductor structure comprising:

a base material;

a plurality of bottom spiral conductors having a first number of turns of the spiral disposed on the base material, the plurality bottom spiral conductor having thicknesses $t_{bot1}$, $t_{bot2}$, . . . $t_{botn}$ measured in a vertical direction from the base material;

at least one top spiral conductor having a second number of turns of the spiral in contact with the plurality of bottom spiral conductors, the at least one top spiral conductor having a thickness $t_{top1}$ measured in a vertical direction from the base material, such that $t_{top1}$ is greater than $t_{bot1}$, $t_{bot2}$, . . . $t_{botn}$; and dielectric material separating the bottom and top spiral conductors;

each turn of the at least one top spiral conductor being in axial alignment with a turn of the plurality of bottom spiral conductors, the inductor structure having a current path from a turn of the at least one top spiral conductor to an axially aligned turn of the plurality of bottom spiral conductors to a next turn of the plurality of bottom spiral conductors to an axially aligned turn of the at least one top spiral conductor to a next turn of the top spiral conductor and continuing until the current path has passed through all turns of the at least one top spiral conductor and the plurality of bottom conductors, wherein each of the plurality of bottom spiral conductors and at least one top spiral conductor each have a width and a turn to turn spacing measured in a direction parallel to the base material wherein the width of each of the plurality of bottom spiral conductors, $W_{thin}$, is greater than the width of the at least one top spiral conductor, $W_{thick}$, and wherein the turn to turn spacing of each of the plurality of bottom spiral conductors, $S_{thin}$, is smaller than the turn to turn spacing of the at least one top spiral conductor, $S_{thick}$, and wherein the inductor has an outside diameter, OD, and an inside diameter, ID, such that:

$W_{thick}+S_{thick}=W_{thin}+S_{thin}$, $ID=OD-(2)(n1)(W_{thick}\ S_{thick})$ where n1=the number of turns of the topmost conductor of the inductor structure $S_{thin}$ is specified by design rules for minimum spacing, and $W_{thin}=((OD-ID)/n1)-S_{thin}$.

4. The inductor of claim 3 wherein there are a plurality of top spiral conductors each having a width, $W_{thick}$, and a turn to turn spacing of $S_{thick}$.

5. The inductor of claim 3 wherein there are a plurality of top spiral conductors having thicknesses $t_{top1}$, $t_{top2}$, . . . $t_{topn}$ such that $t_{top1}$, $t_{top2}$, . . . $t_{topn}>t_{bot1}$, $t_{bot2}$, . . . $t_{botn}$.

* * * * *